US010774703B2

(12) United States Patent
Morishita et al.

(10) Patent No.: US 10,774,703 B2
(45) Date of Patent: Sep. 15, 2020

(54) OIL MIST SEPARATOR

(71) Applicant: TOYOTA BOSHOKU KABUSHIKI KAISHA, Aichi-ken (JP)

(72) Inventors: Hideto Morishita, Gifu-ken (JP); Yoji Horiuchi, Aichi-ken (JP); Naritsune Miyanaga, Aichi-ken (JP)

(73) Assignee: TOYOTA BOSHOKU KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 15/718,791

(22) Filed: Sep. 28, 2017

(65) Prior Publication Data

US 2018/0119587 A1 May 3, 2018

(30) Foreign Application Priority Data

Oct. 28, 2016 (JP) ..... 2016-212238

(51) Int. Cl.
*F01M 13/04* (2006.01)
*F01M 13/00* (2006.01)

(52) U.S. Cl.
CPC ..... *F01M 13/04* (2013.01); *F01M 2013/0072* (2013.01); *F01M 2013/0433* (2013.01); *F01M 2013/0461* (2013.01)

(58) Field of Classification Search
CPC ..... F01M 13/04; F01M 2013/0072; F01M 2013/0461; F01M 2013/0433
USPC ..... 123/572–574
See application file for complete search history.

(56) References Cited

U.S. PATENT DOCUMENTS 4,627,406 A * 12/1986 Namiki ..... F01M 13/04 123/572
7,117,858 B2 * 10/2006 Nonaka ..... F01M 13/0416 123/572
8,726,876 B2 * 5/2014 Kobayashi ..... F01M 13/0416 123/196 CP (Continued)

FOREIGN PATENT DOCUMENTS

CN 203463168 3/2014
CN 203476568 3/2014

(Continued)

OTHER PUBLICATIONS

Japanese Office Action for JP2016-212238 dated Feb. 4, 2020, along with English-language translation.

(Continued)

*Primary Examiner* — Phutthiwat Wongwian
*Assistant Examiner* — Diem T Tran
(74) *Attorney, Agent, or Firm* — Greenblum & Bernstein, P.L.C.

(57) ABSTRACT

An oil mist separator includes a housing and an oil separating part which separates oil mist in blow-by gas. The oil separating part is composed of a first oil separating part and a second oil separating part. The housing is provided inside with a partition wall which defines chambers formed for the respective oil separating parts, and second nozzles which jet out blow-by gas are provided in a second partition wall which defines a second chamber in which the downstream-side second oil separating part is provided. The second nozzles can serve, for example, as passages for discharging the oil separated by the second oil separating part toward a drain pipe which is provided in a first chamber.

7 Claims, 5 Drawing Sheets

(56) References Cited

U.S. PATENT DOCUMENTS

| | | | | |
|---|---|---|---|---|
| 8,794,221 | B2 * | 8/2014 | Kobayashi | F01M 13/0416 123/572 |
| 9,133,742 | B2 * | 9/2015 | Hwang | F01M 13/04 |
| 2005/0092267 | A1 * | 5/2005 | Nonaka | F01M 13/0416 123/41.86 |
| 2007/0215128 | A1 * | 9/2007 | Yonebayashi | F01M 13/0416 123/572 |
| 2012/0312272 | A1 | 12/2012 | Kobayashi et al. | |
| 2013/0125865 | A1 * | 5/2013 | Kobayashi | F01M 13/0416 123/573 |
| 2015/0052862 | A1 | 2/2015 | Wakabayashi | |

FOREIGN PATENT DOCUMENTS

| | | |
|---|---|---|
| EP | 3034823 | 6/2016 |
| JP | 62-071322 | 5/1987 |
| JP | 2009-121281 | 6/2009 |
| JP | 2010-017823 | 1/2010 |
| JP | 2012-255372 | 12/2012 |
| JP | 2014-238032 | 12/2014 |
| JP | 2015-4330 | 1/2015 |
| JP | 2016-114034 | 6/2016 |

OTHER PUBLICATIONS

Chinese Office Action issued in Chinese Patent Application No. 201710984724.8 dated Jul. 8, 2019, along with English language translation.

Chinese Office Action issued in Chinese Patent Application No. CN 201710984724.8 dated Mar. 2, 2020, along with English translation.

* cited by examiner

OIL MIST SEPARATOR

CROSS-REFERENCE TO RELATED APPLICATIONS

The present application claims priority under 35 U.S.C. § 119 of Japanese Application No. 2016-212238 filed on Oct. 28, 2016, the disclosure of which is expressly incorporated by reference herein in its entirety.

BACKGROUND

1. Technical Field

The present invention relates to an oil mist separator which separates oil mist in blow-by gas generated in an engine.

2. Related Art

Conventionally, there has been used an oil mist separator which separates oil mist contained in blow-by gas generated in an engine and returns the oil to an oil pan of the engine. Concerning this oil mist separator, for example, the oil mist separator described in JP 2015-4330 A is known, and the oil mist separator described therein comprises a housing which is provided with an upstream-side half-split body in which an inflow port for blow-by gas is formed and a downstream-side half-split body in which an outflow port for blow-by gas is formed, and is configured in such a manner that an oil separating part is held between the upstream-side half-split body and the downstream-side half-split body.

However, the oil mist separator described in JP 2015-4330 A has a single structure in which the oil separating part is provided in only one position, and thus oil basically cannot be collected at a collection rate according to pressure loss. Contrary to this, in JP 2009-121281 A, a partition wall is provided in approximately the center in the axial direction of a housing, and an oil separating part is provided on the upstream side and downstream side thereof, respectively, i.e., two oil separating parts are provided in series in a flowing direction of blow-by gas. The oil mist separator provided with the two oil separating parts has a large oil collection rate as compared with that of the oil mist separator of JP 2015-4330 A which is provided with one oil separating part.

In the oil mist separator described in JP 2009-121281 A, however, the blow-by gas having flown into the housing is jetted out from an inflow port having a large flow channel area as compared with the nozzle which is provided on the partition wall directly toward an upstream-side primary collision plate, and thus collides with the primary collision plate at a low rate because of its low jetting rate, so that the oil collection efficiency by the oil separating parts is small.

Also, the oil mist separator described in JP 2009-121281 A is provided with two oil separating parts, and thus drain pipes for discharging oil are accordingly provided for the respective oil separating parts. Therefore, when the oil mist separator is installed, for example, in a cylinder head cover, the drain pipes sometimes interfere with peripheral members which are disposed below the oil mist separator, thereby causing failure in installation. Therefore, a broad space is sometimes required below the oil mist separator.

SUMMARY

An object of embodiment of the present invention is to provide an oil mist separator comprising a multiple-structure oil separating part in which the oil collection rate can be increased. In addition to the above-mentioned problem, another object of the embodiment of the present invention is to provide an oil mist separator which can prevent drain pipes from interfering with peripheral members so that the installation space can be reduced.

One aspect of the present embodiments provides 1 an oil mist separator comprising: a housing which is provided with an inflow port and an outflow port for blow-by gas and a drain pipe through which oil is discharged; and an oil separating part which is mounted in the housing to separate oil mist in the blow-by gas, wherein the oil separating part includes a plurality of oil separating parts which are disposed in series in a flowing direction of the blow-by gas, and wherein the oil separating parts each comprise: a partition wall which defines chambers formed for the respective oil separating parts in the housing and is provided with nozzles jetting out blow-by gas; and a collision part with which the blow-by gas jetted out from the nozzles collides.

In a further aspect, the nozzles may serve also as passages for discharging the oil separated by the oil separating part which is provided in a predetermined one of the chambers toward the drain pipe which is provided in another one of the chambers.

In a further aspect, the oil separating parts may include a first oil separating part and a second oil separating part which is arranged on the downstream side of the first oil separating part in a flowing direction of the blow-by gas, wherein the partition plate which constitutes the first oil separating part may be arranged in the vertical direction in the housing, wherein the partition plate which constitutes the second oil separating part may be arranged in the horizontal direction in the housing so that a flow channel is formed between the partition plate and the bottom part of the housing, wherein the drain pipe may be provided in the chamber in which the first oil separating part is provided, and wherein the nozzles of the partition plate which constitutes the second oil separating part may serve also as passages for discharging the oil separated by the second oil separating part toward the drain pipe.

In a further aspect, the oil separating parts may include a first oil separating part and a second oil separating part which is arranged on the downstream side of the first oil separating part in a flowing direction of the blow-by gas, wherein the partition plate which constitutes the first oil separating part may be arranged in the vertical direction in the housing, wherein the partition plate which constitutes the second oil separating part may be arranged in the vertical direction in the housing, wherein the drain pipe may be provided in the chamber in which the second oil separating part is provided, and wherein at least one of the nozzles of the partition plate which constitutes the second oil separating part may be provided in the lowermost part of the partition plate and serves also as a passage for discharging the oil separated by the first oil separating part toward the drain pipe.

In a further aspect, a flowing resistance part which increases the flowing resistance of the blow-by gas may be provided around the upper side of the drain pipe in order to prevent backflow of the oil discharged into the drain pipe.

In a further aspect, the drain pipe may be provided inside with a check valve which prevents backflow of the discharged oil.

According to the oil mist separator of this embodiment, the oil separating part includes a plurality of oil separating parts which are disposed in series in a flowing direction of the blow-by gas, and the oil separating parts each comprise:

a partition wall which defines chambers formed for the respective oil separating parts in the housing and is provided with nozzles jetting out blow-by gas; and a collision part with which the blow-by gas jetted out from the nozzles collides. Thus, in the respective oil separating parts, the blow-by gas is jetted out from the nozzles formed as quite small openings in the partition wall toward the collision part at a high speed. Thus, the collection rate of the oil contained in the blow-by gas can be increased.

When the nozzles serve also as passages for discharging the oil separated by the oil separating part which is provided in a predetermined one of the chambers toward the drain pipe provided in another one of the chambers, the oil separated by the oil separating part and remaining on the bottom surface of the chamber flows through the passages (i.e., nozzles) into the drain pipe which is provided in the other chamber, and is discharged. Thus, no drain pipe has to be installed in the predetermined chamber which is provided with the oil separating part. As a result, it is possible to avoid the interference of the drain pipe with peripheral members located blow the oil mist separator and to reduce the installation space for the oil mist separator.

Further, when the oil separating parts include a first oil separating part and a second oil separating part; the partition plate which constitutes the first oil separating part is arranged in the vertical direction in the housing; the partition plate which constitutes the second oil separating part is arranged in the horizontal direction in the housing so that a flow channel is formed between the partition plate and the bottom part of the housing; the drain pipe is provided in the chamber in which the first oil separating part is provided; and the nozzles of the partition plate which constitutes the second oil separating part serve also as passages for discharging the oil separated by the second oil separating part toward the drain pipe, the oil separated by the second oil separating part and remaining on the partition plate flows through the passages (i.e., nozzles) to the flow channel and then into the drain pipe, and is discharged. Thus, no drain pipe has to be installed in the chamber which is provided with the second oil separating part.

When the oil separating parts include a first oil separating part and a second oil separating parts; the partition plate which constitutes the first oil separating part is arranged in the vertical direction in the housing; the partition plate which constitutes the second oil separating part is arranged in the vertical direction in the housing; the drain pipe is provided in the chamber in which the second oil separating part is provided; and at least one of the nozzles of the partition plate which constitutes the second oil separating part is provided in the lowermost part of the partition plate and serves also as a passage for discharging the oil separated by the first oil separating part toward the drain pipe, the oil separated by the first oil separating part and retaining on the lower surface of the chamber flows through the passage (i.e., nozzle) into the drain pipe, and is discharged. Thus, no drain pipe has to be installed in the chamber which is provided with the first oil separating part.

When a flowing resistance part which increases the flowing resistance of the blow-by gas is provided around the upper side of the drain pipe in order to prevent backflow of the oil discharged into the drain pipe, the oil can be prevented from flowing back and being mixed in the blow-by gas again and returned to the intake system.

Further, when the drain pipe is provided inside with a check valve which prevents backflow of the discharged oil, the oil can be prevented from flowing back and being mixed in the blow-by gas again and returned to the intake system, and at the same time, the drain pipe can be shortened, thereby making it possible to avoid the interference of the drain pipe with peripheral members located below the oil mist separator and to reduce the installation space for the oil mist separator.

BRIEF DESCRIPTION OF DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

First Embodiment

First, a detailed description will be given of an oil mist separator of the first embodiment according to the present invention based on drawings.

Figure 1:
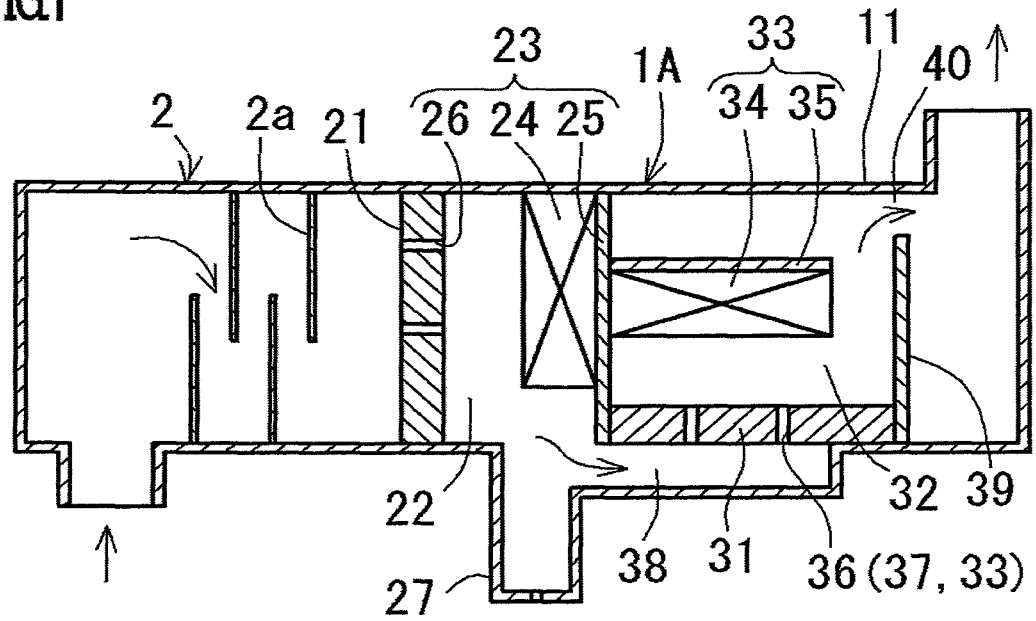
FIG. 1 is a vertical cross-sectional view showing an oil mist separator of an embodiment of the present invention.

The blow-by gas generated in an engine is returned to an intake system and re-combusted, after separation of the oil contained in the blow-by gas during passage through the oil mist separator. On the other hand, the separated oil is discharged from a drain pipe, and recovered in the engine. The oil mist separator of the first embodiment is provided in the middle of a flow channel for blow-by gas, and installed in a cylinder head cover. The oil mist separator is integrally provided, on the upstream side, with a pre-separator 2 which traps large oil droplets in blow-by gas first by means of an oil separating part 2*a* having a labyrinth structure, as shown in FIG. 1. Incidentally, the configuration of a body portion of an oil mist separator, except the pre-separator 2, will be described in each of the following embodiments.

Figure 2:
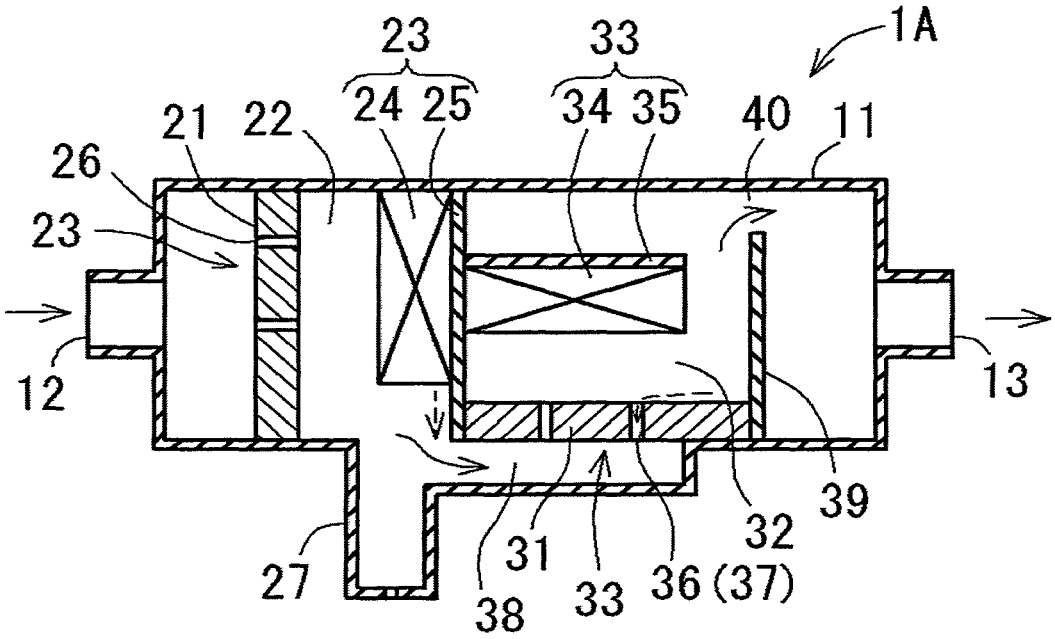
FIG. 2 is a vertical cross-sectional view showing a body portion of an oil mist separator in a first embodiment.

FIG. 2 shows a body portion of an oil mist separator 1A, and the body portion of the oil mist separator 1A is integrally bonded to the pre-separator 2, but for convenience of description, the left and right end parts of the oil mist separator 1A are designated as an inflow port 12 and an outflow port 13, respectively, on an axis line schematically shown in FIG. 2. The oil mist separator 1A comprises a housing 11 which is provided with a drain pipe 27 through which oil is discharged and an oil separating part which is disposed in the housing 11 and separates oil mist in the blow-by gas generated in an engine.

The housing 11 is formed of a synthetic resin in a cylindrical shape, and comprises the inflow port 12 and the outflow port 13. The housing 11 is provided inside with a first partition wall 21 in the vertical direction and a second partition wall 31 in the horizontal direction, and thus comparted into an upstream-side first chamber 22 and a downstream-side second chamber 32. Two oil separating parts are provided; an upstream-side first oil separating part 23 is provided in the first chamber 22, and a downstream-side second oil separating part 33 is provided in the second chamber 32. Although the first oil separating part 23 and the second oil separating part 33 are different in terms of the installation direction and the like, they are disposed in series in a flowing direction of blow-by gas as a whole. Hereinafter, the respective members will be further described.

The first partition wall 21 is erected vertically so as to block a flow channel for blow-by gas in a position which is spaced apart from the inflow port 12 by a predetermined distance to the downstream side. Further, a first filter 24 which is made of, for example, a fibrous body such as a nonwoven fabric, paper, woven fabric or knitted fabric, a resin continuous foamed body, or a porous material is disposed in the vertical direction in a position which is spaced apart from the first partition wall 21 by a predetermined distance to the downstream side in the first chamber 22, and a first collision plate 25 is bonded along the back surface, i.e., downstream-side surface of the first filter 24. A plurality of first nozzles 26 which comprise pores jetting blow-by gas toward the first filter 24 and the first collision plate 25 are provided in a position opposite to the first filter 24 in the first partition wall 21. The first partition wall 21 and the first filter 24 and first collision plate 25 (exemplified as "collision part" according to the present invention) constitute the impactor filter type first oil separating part 23. In addition, a drain pipe 27, which discharges the oil separated by the first oil separating part 23 and remaining in the bottom part of the first chamber 22, is provided in the bottom part located below the first filter 24 in the first chamber 22. The drain pipe 27 is provided, in its lower end opening, with a blocking plate which blocks this opening, and a through hole having a small diameter is formed in this blocking plate so that the oil flowing and pooled inside flows downward from this through hole, and is recovered in a drain pan within the engine.

A second chamber 32 is formed, via a second partition wall 31, on the downstream side adjacent to the first chamber 22. The second partition wall 31 is provided in the horizontal direction in the bottom part of the second chamber 32, and a flow channel 38 which communicates with the first chamber 22 is formed below the second partition wall 31. Further, a second filter 34 having the same specification as that of the first filter 24 is disposed in the horizontal direction in a position which is spaced apart upward from the second partition wall 31 by a predetermined distance in the second chamber 32. Also, a second collision plate 35 is bonded along the back surface, i.e., upper surface of the second filter 34. The second partition wall 31 blocks a flow channel 38 which is located below the second partition wall 31, and is provided with a plurality of second nozzles 36 which comprise pores jetting blow-by gas toward the second filter 34 and the second collision plate 35 in a position opposite to the second filter 34. These second nozzles 36 function also as passages 37 for discharging the oil separated by the second oil separating part 33 toward the drain pipe 27 provided in the first chamber 22. The second partition wall 31 and the second filter 34 and second collision plate 35 (exemplified as "collision part" according to the present invention) constitute the impactor filter type second oil separating part 33. A partition 39 is erected on the bottom surface of the second chamber 32 closer to the downstream, and a gap 40 through which blow-by gas passes is formed between the upper end part of the partition 39 and the ceiling surface of the second chamber 32.

Next, separation of the oil in blow-by gas by the oil mist separator 1A of the first embodiment configured in the above-mentioned manner will be described.

The blow-by gas generated in the engine and flowing through the flow channel flows from the inflow port 12 of the oil mist separator 1A as the body portion into the housing 11, after separation of large oil droplets in the oil separating part 2*a* of the pre-separator 2.

Then, blow-by gas is jetted out from the first nozzles 26 of the first partition wall 21 toward the first filter 24 and first collision plate 25 in the first oil separating part 23 of the first chamber 22. At this time, the first nozzles 26 are formed of quite small openings, and thus blow-by gas is accelerated when passing through this portion. Then, blow-by gas collides with the front surface of the first filter 24 which is spaced apart from the first partition wall 21 by a predetermined distance, and a part thereof passes through the inside of the first filter 24, and collides with the first collision plate 25. By this collision, the oil mist in blow-by gas is trapped by the first filter 24 and the first collision plate 25, separated from blow-by gas, and dropped onto the bottom surface of the first chamber 22 along the first filter 24 and the first collision plate 25. Also, a part of blow-by gas having passed through the inside of the first filter 24 is trapped by the filtration of the first filter 24 while passing therethrough, and similarly dropped onto the bottom surface of the first chamber 22 by its own weight. The oil dropped onto the bottom surface of the first chamber 22 flows into the drain pipe 27 of the first chamber 22, returns to the oil pan in the engine, and is recovered. Thus, a considerable portion of the oil is separated from the blow-by gas flowing in the first chamber 22 by the first oil separating part 23. On the other hand, the blow-by gas having collided with the first filter 24 and the first collision plate 25 and the blow-by gas flowing around to the lower side without colliding with these members flow from the bottom part of the first chamber 22 to the lower side of the second partition wall 31 of the second chamber 32 along the flow channel 38.

Next, the blow-by gas flowing to the side of the second chamber 32 is jetted out from the second nozzles 36 in the second partition wall 31 arranged in the horizontal direction toward the second filter 34 and the second collision plate 35 located above. Then, the blow-by gas collides with the lower surface of the second filter 34 in a similar manner as the first oil separating part 23, and at the same time, a part thereof passes through the inside of the second filter 34, and collides with the second collision plate 35. Thus, the oil mist remaining in the blow-by gas from which a considerable amount of the oil mist has been separated and removed by the first oil separating part 23 is trapped by the second oil separating part 33, separated from the blow-by gas, dropped onto the upper surface of the second partition wall 31, and pooled in this portion. Also, the blow-by gas having collided with the second filter 34 and the second collision plate 35 and the blow-by gas flowing around to the side without colliding with these members flow out of the outflow port 13 through the gap 40 formed between the ceiling surface of the second chamber 32 and the upper end part of the partition 39, and are returned to the intake system of the engine.

On the other hand, the oil dropped onto the second partition wall 31 in the second chamber 32 and pooled during operation of the engine is not sucked into the second chamber 32 by negative pressure because the negative pressure in the second chamber 32 becomes equal to the atmospheric pressure when the engine stops, passes through the inside of the second nozzles 36 which function also as the passages 37 in the second partition wall 31 and falls into the lower flow channel 38 which communicates with the first chamber 22, by its own weight, further flows through the flow channel 38 into the drain pipe 27 which is provided in the bottom part of the first chamber 22, and is returned in the engine. In other words, the oil separated by the first oil separating part 23 and the oil separated by the second oil separating part 33 join together and are discharged to the drain pipe 27 which is provided in the first chamber 22. In the drawing, dotted lines indicate oil flow.

Figure 3:
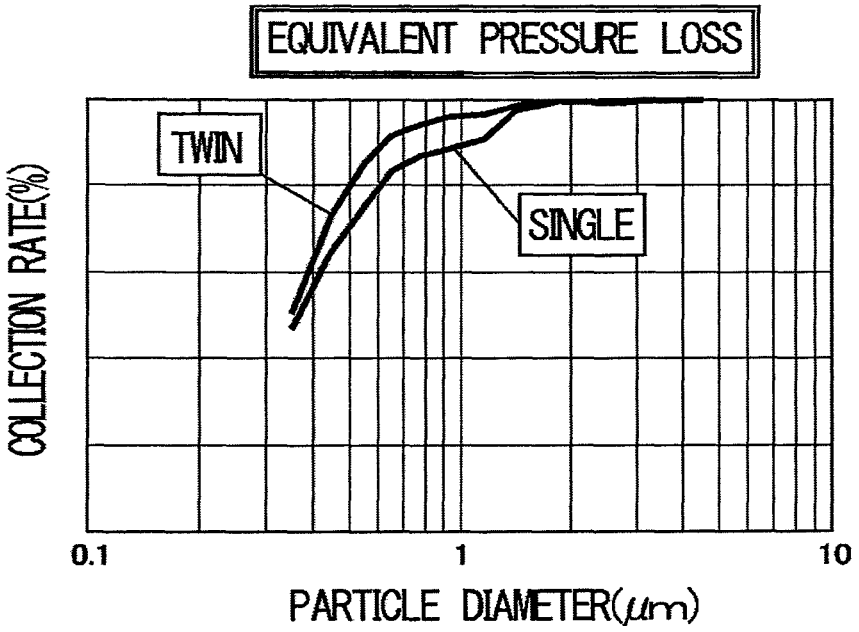
FIG. 3 is a graph of comparison between the oil mist separator of the present invention and a conventional oil mist separator in terms of the collection rate.

In this way, the oil mist separator 1A in which the oil in blow-by gas is separated by the twin oil separating part structure provides an equivalent or higher collection rate as compared with a conventional oil mist separator in which only one oil separating part is arranged in a housing, as shown in FIG. 3. FIG. 3 shows results obtained by measuring the collection rates for the respective particle diameters of particles collected by the entire oil mist separator under the condition of the same pressure loss for an oil mist separator comprising only one oil separating part and an oil mist separator comprising two oil separating parts. As is evident from FIG. 3, both of the oil mist separators provide an approximately equivalent collection rate in a region with a large particle diameter, but the oil mist separator comprising two oil separating parts provides a larger collection rate in any other particle diameter regions.

Next, the drain pipe 27 provided in the first chamber 22 will be compared, in terms of length, with a conventional drain pipe including one oil separating part.

Since the pressure on the outflow side of the oil mist separator is negative pressure during operation of the engine, the oil discharged in the drain pipe may be sucked into the housing, mixed in blow-by gas again and brought out through the outflow port 13 to the intake system. Therefore, the drain pipe is set to have a length which allows the drain pipe to store therein a predetermined volume of oil and prevents oil from being mixed in blow-by gas again by suction by negative pressure, in consideration of the pressure difference between the pressure by the load of the oil and the negative pressure on the discharge side. Since the negative pressure on the outflow side becomes larger in proportion to the pressure loss level of the oil mist separator, it is necessary to elongate the drain pipe accordingly for increasing the volume of oil to be stored.

Figure 4A:
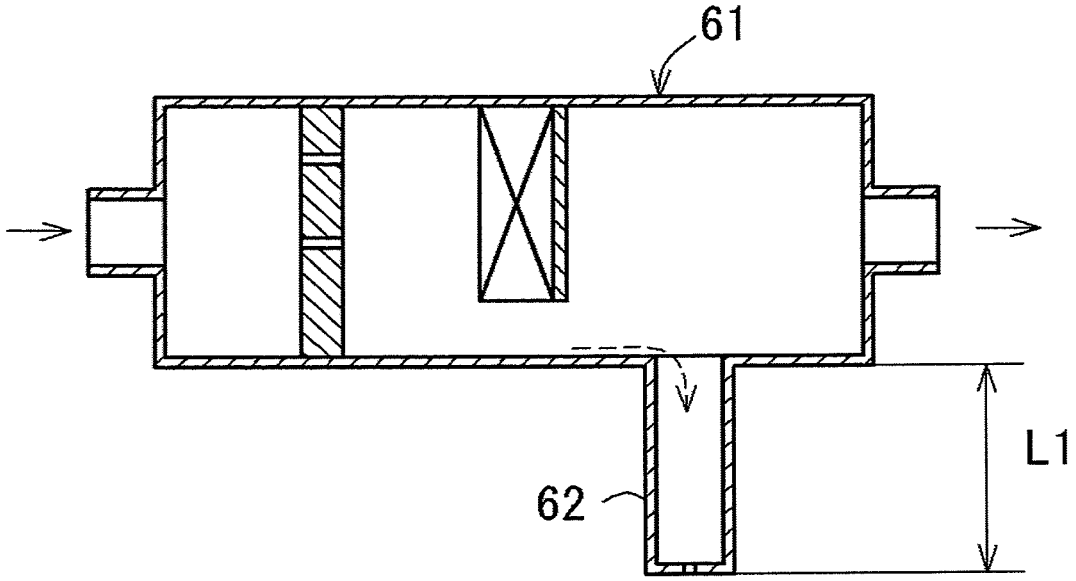
FIGS. 4A and 4B show a vertical cross-sectional view for comparison between the conventional oil mist separator and the oil mist separator of the first embodiment in terms of the length of a drain pipe.
Figure 4B:
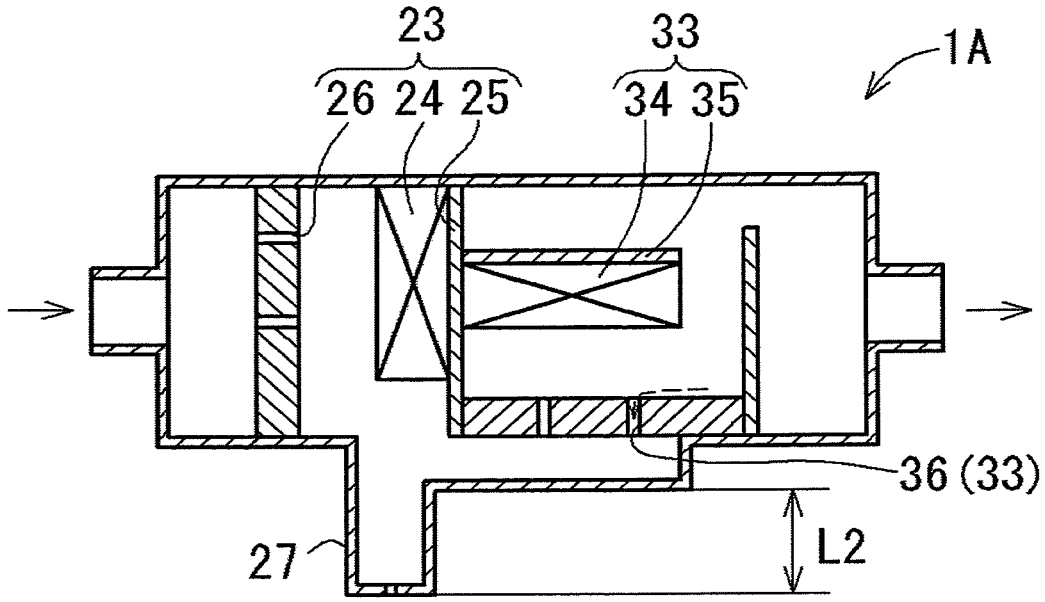

Now, the drain pipe provided in the conventional oil mist separator comprising only one oil separating part is assumed to be set so as to have a length corresponding to the pressure loss of the entire oil mist separator, i.e., a length L1 as shown in FIG. 4A. On the other hand, the drain pipe 27 provided only in the first chamber 22 of the oil mist separator 1A of the first embodiment according to the present invention has a length corresponding to the pressure loss of the first oil separating part 23 of the first chamber 22. Assuming that the first oil separating part 23 and the second oil separating part 33 are set to have the same specification, the pressure loss of the first oil separating part 23 is half the pressure loss of the entire oil mist separator 1A. Thus, as shown in FIG. 4B, when the length of the drain pipe 27 of the first embodiment according to the present invention is defined as L2, L2=L1×(½) is satisfied. A half length of the drain pipe of the conventional oil mist separator is enough for the drain pipe 27.

Next, the action of the above-mentioned oil mist separator 1A of the first embodiment will be described.

The oil mist separator 1A includes two oil separating parts which are disposed in series in a flowing direction of blow-by gas, and thus has an increased oil collection rate and an improved collection performance under the condition of the same pressure loss, as compared with the oil mist separator which is provided with one oil separating part, as mentioned above.

In addition, the second nozzles 36 which jet out blow-by gas are provided in the second partition wall 31 on the downstream side. The second nozzles 36 function also as the passages 37 for discharging the oil separated by the second oil separating part 33 toward the drain pipe 27 which is provided in the first chamber 22, and thus the oil separated by the second oil separating part 33 and remaining on the upper surface of the second partition wall 31 which serves also as the bottom surface of the second chamber 32 passes through the second nozzles 36 which serve also as the passages 37, and is guided into the drain pipe 27 which is provided in the first chamber 22, and discharged, when the engine stops or the flow rate of blow-by gas is lowered. Thus, the drain pipe 27 does not have to be installed in the second chamber 32 in which the second oil separating part 33 is provided, and one drain pipe is enough in the entire oil mist separator 1A whereas the conventional oil mist separator comprising two oil separating parts requires two drain pipes. As a result, if a drain pipe is also installed in the second chamber 32, it is possible to avoid the interference of this drain pipe with peripheral members located below the oil mist separator 1A, and to reduce the installation space for the oil mist separator 1A. Further, the number of drain pipes can be decreased to one, with the result that reduction in cost and simplification of the configuration of the oil mist separator 1A are achieved.

Also, since the oil mist separator 1A comprises two oil separating parts, a half length of the drain pipe of the conventional oil mist separator comprising one oil separating part is enough for the drain pipe 27 in the first chamber 22. Thus, it is possible to reduce and save the space occupied by the drain pipe 27, and to reduce the interference between the drain pipe 27 and the peripheral members located below.

The oil mist separator 1A of the above-mentioned embodiment includes impactor filter type oil separating parts which are built in the housing 11, but the present invention can similarly employ impactor type oil separating parts which cause blow-by gas jetted out from the nozzles at a high speed to collide with a collision wall (exemplified as "collision part" according to the present invention) to trap and separate the oil contained therein.

Second Embodiment

Then, an oil mist separator of the second embodiment according to the present invention will be described. The oil mist separator of the second embodiment is identical with the oil mist separator 1A of the first embodiment in terms of comprising two oil separating parts and one drain pipe, but is different therefrom, for example, in terms of the position where the drain pipe is installed.

Figure 5:
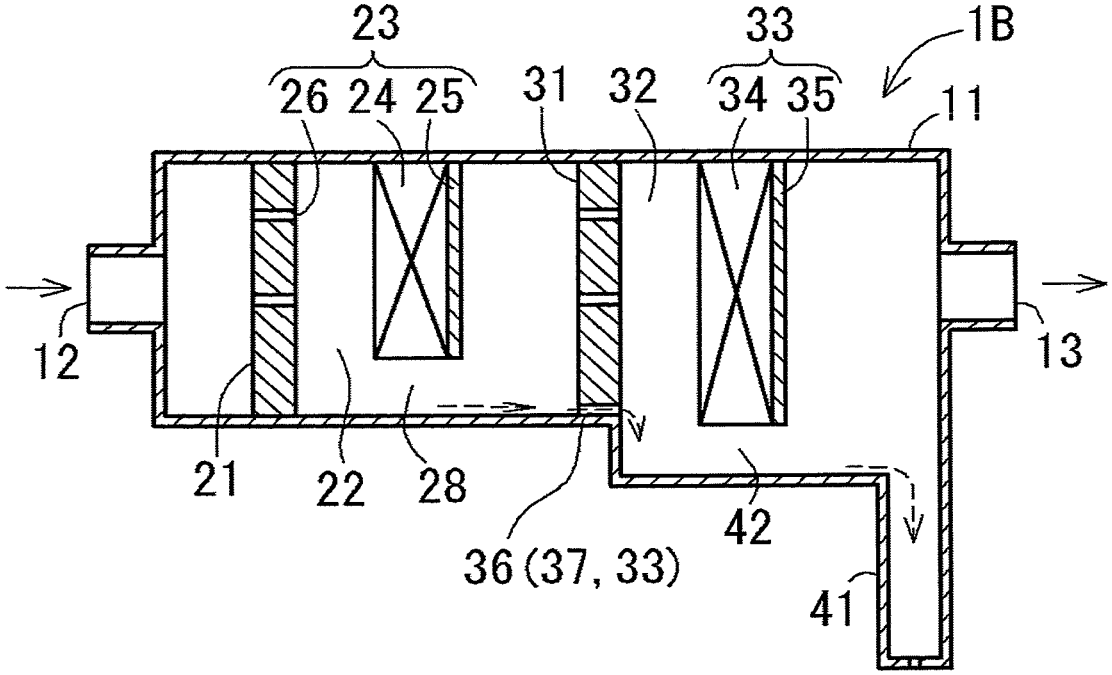
FIG. 5 is a vertical cross-sectional view showing a body portion of an oil mist separator in a second embodiment.

In FIG. 5, a housing 11 of an oil mist separator 1B is provided with a first partition wall 21 in the vertical direction on the upstream side and a second partition wall 31 similarly in the vertical direction on the downstream side, and thus comparted into an upstream-side first chamber 22 and a downstream-side second chamber 32. An oil separating part is composed of an upstream-side first oil separating part 23 provided in a first chamber 22 and a downstream-side second oil separating part 33 provided in a second chamber 32, which are disposed in series along a flowing direction of blow-by gas.

More specifically, the first partition wall 21 is erected vertically so as to block a flow channel for blow-by gas in a position which is spaced apart from an inflow port 12 by a predetermined distance to the downstream side. Also, a first filter 24, which is similar to the filter of the first embodiment, is disposed in the vertical direction in a position which is spaced apart from the first partition wall 21 by a predetermined distance to the downstream side in the first chamber 22, and further, a first collision plate 25 is bonded along the back surface, i.e., downstream-side surface of the first filter 24. A plurality of first nozzles 26 which jet blow-by gas toward the first filter 24 and the first collision plate 25 are provided in a position opposite to the first filter 24 in the first partition wall 21. The first partition wall 21 and the first filter 24 and first collision plate 25 (exemplified as "collision part" according to the present invention) constitute the impactor filter type first oil separating part 23. A gap 28, through which the blow-by gas jetted out from the first nozzles 26 in the first partition wall 21 and colliding with or passing through the first filter 24 and the blow-by gas flowing around to the lower side of the first filter 24 without colliding with or passing through the first filter 24 flow, is provided between the lower end part of the first filter 24 and the bottom surface of the first chamber 22.

A second partition wall 31, which is provided in the downstream-side second chamber 32 adjacent to the first chamber 22, is erected vertically so as to block the flow channel in a position which is spaced apart from the first collision plate 25 by a predetermined distance. Also, a second filter 34, which is made of a material similar to that for the first filter 24, is disposed in the vertical direction in a position which is spaced apart from the second partition wall 31 by a predetermined distance to the downstream side in the second chamber 32, and further, a second collision plate 35 is bonded along the back surface of the second filter 34. A plurality of second nozzles 36 which jet out blow-by gas toward the second filter 34 and the second collision plate 35 are provided in a position opposite to the second filter 34 in the second partition wall 31, and at least one of these second nozzles 36 is provided in the lowermost part of the second partition wall 31. This second nozzle 36 functions also as a passage 37 for discharging the oil separated by the upstream-side first oil separating part 23 toward a drain pipe 41 which is provided in the downstream-side second chamber 32 (which will be described later), as with the second nozzle 36 which is provided in the second partition wall 31 of the first embodiment. The second partition wall 31 and the second filter 34 and second collision plate 35 (exemplified as "collision part" according to the present invention) constitute the impactor filter type second oil separating part 33.

A gap 42, through which the blow-by gas jetted out from the second nozzles 36 in the second partition wall 31 and colliding with or passing through the second filter 34 and the blow-by gas flowing around to the lower side of the second filter 34 without colliding with or passing through the second filter 34 flow, is provided between the lower end part of the second filter 34 and the bottom surface of the second chamber 32. Further, a drain pipe 41 which discharges the oil separated by the second oil separating part 33 is provided vertically downward at the outflow-side end part in the bottom surface of the second chamber 32.

The thus-configured oil mist separator 1B of the second embodiment is not provided with any drain pipe in the first chamber 22, but the second nozzle 36, which is formed in the lowermost part of the second partition wall 31, functions also as the passage 37 through which the separated oil flows. Hence, the oil dropped onto the bottom surface of the first chamber 22 and pooled during operation of the engine is not sucked by negative pressure in the first chamber 22, flows along the bottom surface of the first chamber 22 to the downstream side by its own weight, passes through the inside of the second nozzle 36 which serves also as the passage 37 in the lowermost part of the second partition wall 31, is guided into the second chamber 32, further flows on the bottom surface of the second chamber 32 to the downstream side, and flows into the drain pipe 41, when the engine stops. In other words, the oil separated by the first oil separating part 23 and the oil separated by the second oil separating part 33 join together and are discharged to the drain pipe 41 which is provided in the second chamber 32.

By virtue of this, the drain pipe 41 does not have to be installed in the first chamber 22 which is provided with the first oil separating part 23. As a result, as with the oil mist separator of the first embodiment, if a drain pipe is also installed in the first chamber 22, it is possible to avoid the interference of this drain pipe with peripheral members located below the oil mist separator 1B, and to reduce and save the installation space for the oil mist separator 1B. Further, the number of drain pipes can be decreased to one, with the result that reduction in cost and simplification of the configuration of the oil mist separator 1B are achieved. Further, in general, among peripheral members of the engine which are located below the oil mist separator, a large number thereof are located immediately below the center part of the oil mist separator, and a small number thereof are located on the end part side of the oil mist separator. However, the drain pipe 41 of the second embodiment is provided at the outflow-side end part of the second chamber 32, and thus the interference with the peripheral members of the engine can be further reduced.

Third Embodiment

Next, an oil mist separator of the third embodiment according to the present invention will be described. The oil mist separator of the third embodiment comprises two oil separating parts as with the oil mist separators of the first and second embodiments, but is different therefrom, for example, in that two drain pipes are provided.

Figure 6:
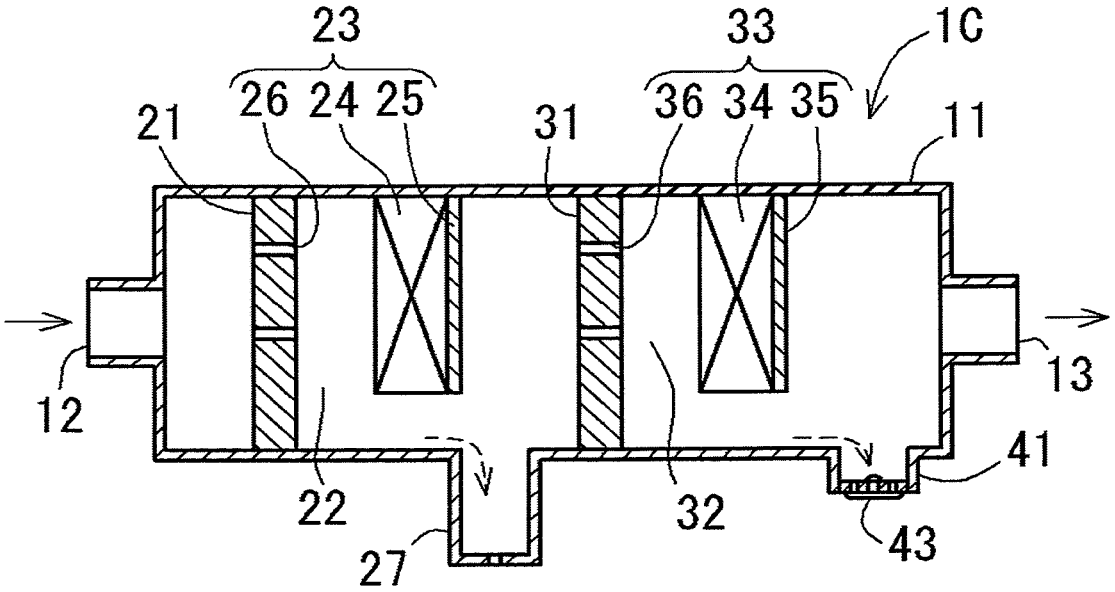
FIG. 6 is a vertical cross-sectional view showing a body portion of an oil mist separator in a third embodiment.

In FIG. 6, a housing 11 of an oil mist separator 1C is provided inside with a first partition wall 21 in the vertical direction on the upstream side and a second partition wall 31 in the vertical direction on the downstream side, and thus comparted into an upstream-side first chamber 22 and a downstream-side second chamber 32, as with the second embodiment. An oil separating part is composed of an upstream-side first oil separating part 23 provided in the first chamber 22 and a downstream-side second oil separating part 33 provided in the second chamber 32, which are disposed in series along a flowing direction of blow-by gas. The respective oil separating parts have specification and configuration similar to those of the respective oil separating parts of the second embodiment.

On the other hand, the oil mist separator 1C of the third embodiment is provided with a drain pipe in the bottom part of the first chamber 22 and the bottom part of the second chamber 32, respectively. Further, a drain pipe 41 in the second chamber 32 is provided with a check valve 43 which prevents backflow of the oil once discharged in the drain pipe 41. The drain pipe 41 is provided, in its lower end opening, with a blocking plate which blocks this opening, and a through hole having a small diameter is formed in this blocking plate. A check valve 43 (not shown) is mounted on the blocking plate so as to hold this blocking plate vertically. Further, in the check valve 43, an opening/closing valve which freely blocks the through hole to be openable/closable is mounted in the lower portion of the blocking plate. When the pressure on the side of the oil mist separator 1C is negative pressure, the valve body, which is made of a soft material, of the opening/closing valve is sucked to the blocking plate side and blocks the through hole. When the pressure within the oil mist separator 1C is equal to the atmospheric pressure upon stop of the engine, the valve body of the opening/closing valve recovers in a direction spaced apart from the blocking plate and brings the through hole in an open state. Hence, the oil pooled in the drain pipe 41 flows down from the through hole by its own weight. By virtue of this, the oil once separated and recovered during operation of the engine is prevented from flowing back from the drain pipe 41 and being mixed in blow-by gas again and returned to the intake system.

Also, a plurality of second nozzles 36 are formed opposite to the second filter 34 in the second partition wall 31, but no second nozzle 36 is provided in the lowermost part of the second partition wall 31. The oil mist separator 1C of the third embodiment is different from the oil mist separator 1B of the second embodiment in these respects.

In the thus-configured oil mist separator 1C of the third embodiment, blow-by gas is jetted at a high speed from the nozzles in the respective partition walls which constitute the oil separating part toward the respective filters and collision plates so that the oil in the blow-by gas is separated, as with the oil mist separators of the first and second embodiments.

Incidentally, the check valve 43 is provided on the side of the second chamber 32 in the drain pipe 41, but does not have to be provided. In the case where no check valve 43 is provided, assuming that the first oil separating part 23 and the second oil separating part 33 have similar specification, the drain pipe 41 on the side of the second chamber 32 has a length corresponding to the pressure loss of the entire oil mist separator 1C, and thus is twice as long as the drain pipe 27 on the side of the first chamber 22. Here, a considerable amount of the oil contained in blow-by gas is separated in the first oil separating part 23, and a small amount of oil mist remains in the blow-by gas flowing into the second chamber 32. Thus, the drain pipe 41 on the side of the second chamber 32 would actually be short. The check valve 43 may be provided also in the drain pipes of the other embodiments.

Figure 7:
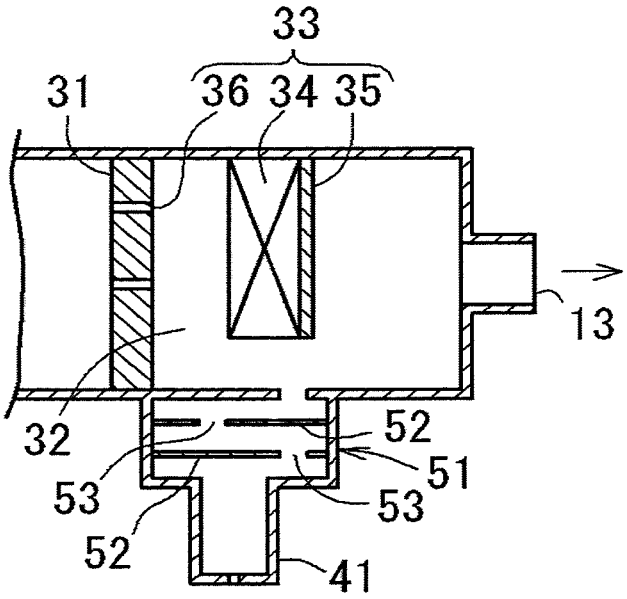
FIG. 7 is a vertical cross-sectional view showing a flowing resistance part provided around the upper side of the drain pipe.

In the above-mentioned respective embodiments, a flowing resistance part 51 which increases the pressure loss of blow-by gas and also increases the flowing resistance may be provided around the upper side of the discharge port of the drain pipe, in order to prevent backflow of the oil discharged into the drain pipe. Specifically, the flowing resistance part 51 can be formed, for example, by adding a horizontal plate 52 having a flowing hole 53 for blow-by gas below the second chamber 32 around the upper side of the discharge port of the drain pipe 41, as shown in FIG. 7, or adding a labyrinth structure in which a plurality of partition plates are alternately disposed in the flow channel, though not shown.

Further, the oil mist separators of the above-mentioned respective embodiments have a twin structure in which two oil separating parts are disposed in series in a flowing direction of blow-by gas, but the present invention, when implemented, may employ a structure in which three or more oil separating parts are disposed.

Furthermore, the first oil separating part 23 and the second oil separating part 33 of the respective embodiments are formed in the same specification or of the same material, and employ the same oil separation system, but may be different from each other.

In addition, the respective partition walls of the respective embodiments are provided with a plurality of nozzles, but may be provided with only one nozzle.

A drain pipe for discharging the trapped oil into the engine may be provided also in the pre-separator 2, as shown in FIG. 1, which is provided adjacent to the upstream side of each of the oil mist separators and traps large oil droplets in blow-by gas.

Also, the oil mist separators of the respective embodiments are installed in the cylinder head cover, but the oil mist separator of the present invention can similarly be applied to structures in which it is installed externally in a flow channel outside the engine.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above-described embodiments, and various variations and modifications may be possible without departing from the scope of the present invention.

The present invention is widely utilized as a technique of separating oil mist in blow-by gas generated in an engine.

What is claimed is:

1. An oil mist separator comprising:

a housing which is provided with an inflow port and an outflow port for blow-by gas and a drain pipe through which oil is discharged; and a plurality of oil separating parts being mounted in the housing and disposed in series in a flowing direction of the blow-by gas to separate oil mist in the blow-by gas, the plurality of oil separating parts including at least a first oil separating part and a second oil separating part arranged on a downstream side of the first oil separating part, wherein the plurality of oil separating parts each comprise:

a partition wall, which defines a chamber formed for the respective oil separating part in the housing, is provided with nozzles for jetting out blow-by gas; and a collision part with which the blow-by gas jetted out from the nozzles collides;

wherein the partition wall of the first oil separating part is arranged in a vertical direction in the housing, wherein the partition wall of the second oil separating part is arranged in a horizontal direction in the housing so that a flow channel is formed between the partition wall and a bottom part of the housing, wherein the drain pipe is provided in the chamber of the first oil separating part, and wherein the nozzles of the partition wall of the second oil separating part also serve as passages for discharging the oil separated by the second oil separating part toward the drain pipe.

2. The oil mist separator according to claim 1, wherein a flowing resistance part which increases the flowing resistance of the blow-by gas is provided around the upper side of the drain pipe in order to prevent backflow of the oil discharged into the drain pipe.

3. The oil mist separator according to claim 1, wherein the drain pipe is provided inside with a check valve which prevents backflow of the discharged oil.

4. The oil mist separator according to claim 1, wherein each of the collision parts has a different installation orientation in the housing.

5. The oil mist separator according to claim 1, wherein the collision part of the first oil separating part is erected vertically within the housing and the collision part of the second oil separating part is disposed horizontally within the housing.

6. The oil mist separator according to claim 1, wherein the drain pipe is provided between the partition walls of the first oil separating part and the second oil separating part.

7. The oil mist separator according to claim 1, further comprising:

a partition that projects upward from a bottom part of the chamber of the second oil separating part so as to be provided between the chamber of the second oil separating part and the outflow port, wherein a gap is defined between an upper end part of the partition and a ceiling of the chamber of the second oil separating part to permit blow-by gas to pass therethrough towards the outflow port.

* * * * *